US010405572B2

(12) United States Patent
Batista

(10) Patent No.: US 10,405,572 B2
(45) Date of Patent: Sep. 10, 2019

(54) REINFORCED WEB OF RECONSTITUTED TOBACCO

(71) Applicant: Philip Morris Products S.A., Neuchatel (CH)

(72) Inventor: Rui Nuno Batista, Morges (CH)

(73) Assignee: Philip Morris Products S.A., Neuchatel (CH)

( * ) Notice: Subject to any disclaimer, the term of this patent is extended or adjusted under 35 U.S.C. 154(b) by 417 days.

(21) Appl. No.: 15/319,173

(22) PCT Filed: May 8, 2015

(86) PCT No.: PCT/EP2015/060268
§ 371 (c)(1),
(2) Date: Dec. 15, 2016

(87) PCT Pub. No.: WO2015/193031
PCT Pub. Date: Dec. 23, 2015

(65) Prior Publication Data

US 2017/0181466 A1 Jun. 29, 2017

(30) Foreign Application Priority Data

Jun. 16, 2014 (EP) ..... 14172610

(51) Int. Cl.
*A24B 3/14* (2006.01)
*A24B 15/12* (2006.01)
*A24B 15/14* (2006.01)

(52) U.S. Cl.
CPC ..... *A24B 15/12* (2013.01); *A24B 3/14* (2013.01); *A24B 15/14* (2013.01)

(58) Field of Classification Search
CPC ..... A24B 3/14; D21H 5/16
See application file for complete search history.

(56) References Cited

U.S. PATENT DOCUMENTS 3,009,835 A 11/1961 Samfield et al.
3,012,914 A 12/1961 Battista et al.
(Continued)

FOREIGN PATENT DOCUMENTS

CN 101011183 A 8/2007
CN 101273796 A 10/2008
(Continued)

OTHER PUBLICATIONS

Combined Office Action and Search Report dated Nov. 3, 2017 in Chinese Patent Application No. 201580028731.X (with English language translation), 16 pages.
(Continued)

*Primary Examiner* — Cynthia Szewczyk
(74) *Attorney, Agent, or Firm* — Oblon, McClelland, Maier & Neustadt, L.L.P.

(57) ABSTRACT

A reinforced tobacco web is provided, including a continuous web of reconstituted tobacco, a first continuous reinforcement incorporated into the web at a first edge, and a second continuous reinforcement incorporated into the web at a second edge. Neither the first continuous reinforcement nor the second continuous reinforcement has a width greater than 15% of the width of the continuous web of reconstituted tobacco. The reinforcements allow the tobacco web to be handled more efficiently by increasing the pulling strength of the web.

13 Claims, 3 Drawing Sheets

(56) References Cited

U.S. PATENT DOCUMENTS

| | | | | | |
|---|---|---|---|---|---|
| 3,409,028 | A | | 11/1968 | de la Burdé | |
| 3,794,048 | A | * | 2/1974 | Molins | A24C 1/30 131/29 |
| 3,860,012 | A | | 1/1975 | Selke | |
| 3,894,544 | A | | 7/1975 | Egri | |
| 3,948,275 | A | * | 4/1976 | Sanford | A24B 3/182 131/352 |
| 4,091,821 | A | * | 5/1978 | Scorzo | A24D 1/10 131/349 |
| 4,243,053 | A | * | 1/1981 | Cartwright | A24D 1/10 131/331 |
| 4,256,124 | A | * | 3/1981 | Higgins | A24C 1/32 131/29 |
| 4,306,578 | A | | 12/1981 | Schmidt et al. | |
| 4,338,956 | A | * | 7/1982 | Sanford | A24D 3/043 131/336 |
| 5,018,536 | A | * | 5/1991 | Liebich | A24C 5/42 131/70 |
| 5,724,998 | A | | 3/1998 | Gellatly et al. | |
| 2013/0142993 | A1 | * | 6/2013 | Bartram | A24C 5/007 428/139 |

FOREIGN PATENT DOCUMENTS

| | | | |
|---|---|---|---|
| CN | 101491369 | A | 7/2009 |
| CN | 203226256 | U | 10/2013 |
| CN | 103445284 | A | 12/2013 |
| CN | 203340993 | U | 12/2013 |
| CN | 103622151 | A | 3/2014 |
| CN | 103653233 | A | 3/2014 |
| CN | 103725632 | A | 4/2014 |
| CN | 103734896 | A | 4/2014 |
| CN | 103783653 | A | 5/2014 |
| CN | 103849173 | A | 6/2014 |
| GB | 983928 | | 2/1965 |
| JP | 54-140798 | | 11/1979 |
| JP | 7-147965 | | 6/1995 |
| JP | 2007-267749 | | 10/2007 |
| RU | 2 195 575 | C1 | 2/2003 |

OTHER PUBLICATIONS

Combined Decision to Grant and Search Report dated Oct, 18, 2018 in Russian Patent Application No. 2017100962/12 (with English translation), 14 pages.

International Search Report and Written Opinion dated Aug. 25, 2015 in PCT/EP2015/060268 filed May 8, 2015.

Japanese Office Action with English translation dated Mar. 22, 2019 in corresponding Japanese Patent Application No. 2016-568403, (8 pages).

* cited by examiner

REINFORCED WEB OF RECONSTITUTED TOBACCO

The present specification relates to a web of reconstituted tobacco comprising a reinforcement and a method of making such a web of reconstituted tobacco. The specification in particular relates to a continuous web of reconstituted tobacco having a composition suitable for use as an aerosol-forming substrate of a heated aerosol-generating article.

Methods of preparing webs and sheets of reconstituted tobacco material are well known. In one method, particles of tobacco such as tobacco fines, dust, and portions of stems and midribs are ground and combined with a binder before being cast into a continuous web. The continuous web is dried to form a reconstituted tobacco web which may be rolled onto a bobbin, or cut into sheets, or shredded to use as filler in conventional cigarettes.

When handling a web of reconstituted tobacco, care must be taken to avoid exerting excess stress during conveying, pulling, winding and unwinding of the web. In order to improve the strength of the web sufficiently to handle the web at adequate processing speeds, it is common to include binders and fibres to increase the web strength of the reconstituted tobacco. Even so, the speed at which the web can be fed through processing apparatus without risk of tearing the web is relatively low. It would be desirable to be able to increase the speed at which webs of reconstituted tobacco may be processed and to reduce the incidence of breakage of such webs during processing.

Reconstituted tobacco material that is intended for use as an aerosol-forming substrate of a heated aerosol-generating article tends to have a different composition to reconstituted tobacco intended for use as filler in conventional cigarettes. In a heated aerosol-generating article, an aerosol-forming substrate is heated to a relatively low temperature, for example about 350° centigrade, in order to form an inhalable aerosol. In order that an aerosol may be formed, the reconstituted tobacco material preferably comprises high proportions of aerosol-formers and humectants such as glycerine or propylene glycol. The need for higher proportions of aerosol-formers and humectants results in a significant loss of mechanical strength in the homogenised tobacco. Thus, sheets or webs of homogenised tobacco intended for use as an aerosol-forming substrate of an aerosol-generating article have a far greater tendency to break or tear when subjected to pulling forces, such as experienced during winding and unwinding of reels the tobacco material. Thus, processing line speeds of such materials are extremely low, and there are regular stoppages during manufacturing due to breakages. This negatively impacts production and increases scrap rate. Thus, it may be particularly desirable to increase the pulling strength of a reconstituted tobacco web intended for use as an aerosol-forming substrate of an aerosol-generating article.

A reinforced tobacco web may be provided, the web comprising a continuous web of reconstituted tobacco having a width defined by a distance between first and second substantially parallel edges. A first continuous reinforcement is incorporated into the continuous web of reconstituted tobacco at the first edge and a second continuous reinforcement is incorporated into the continuous web of reconstituted tobacco at the second edge, thereby forming the reinforced tobacco web. Neither the first continuous reinforcement nor the second continuous reinforcement has a width greater than 15% of the width of the continuous web of reconstituted tobacco. The presence of a reinforcement at each lateral edge of the web of reconstituted tobacco allows an increase in the pulling strength of the web. Thus, a greater force may be applied to the web, by pulling at the edges of the web that comprise the reinforcements, and the speed at which the web may be conveyed, pulled, wound, and unwound may be significantly increased. A continuous web of material such as reinforced tobacco or reconstituted tobacco has a measurable width and thickness but is of indefinite length. A continuous web of reinforced tobacco material may be wound into a roll or bobbin and then cut to be transported as a roll or bobbin. A web of reinforced tobacco may be cut into lengths. A continuous web of reinforced tobacco may also be described as a continuous sheet of reinforced tobacco.

Reconstituted tobacco is a term that encompasses any tobacco material formed by the agglomeration of particles of tobacco material. Reconstituted tobacco may be described as homogenised tobacco. Sheets or webs of reconstituted tobacco may be formed by agglomerating particulate tobacco obtained by grinding or otherwise comminuting one or both of tobacco leaf lamina and tobacco leaf stems. Alternatively, or in addition, sheets of reconstituted tobacco may comprise one or more of tobacco dust, tobacco fines, and other particulate tobacco by-products formed during the treating, handling and shipping of tobacco.

Reconstituted tobacco material may comprise one or more intrinsic binders, one or more extrinsic binders, or a combination thereof to help agglomerate particles of tobacco. Reconstituted tobacco may comprise other additives including, but not limited to, tobacco and non-tobacco fibres, aerosol-formers, humectants, plasticisers, flavourants, fillers, aqueous and non-aqueous solvents, and combinations thereof.

When intended for use as an aerosol-forming substrate of a heater aerosol-generating article, it may be preferred that the reconstituted tobacco has an aerosol-former content greater than 5% on a dry weight basis. Preferably, reconstituted tobacco for use in heated aerosol-generating articles may have an aerosol-former content of between 5% and 30% by weight on a dry weight basis.

The reconstituted tobacco may be cast leaf tobacco. Cast leaf is a term used for a form of reconstituted tobacco that is formed from a slurry including tobacco particles, fiber particles, aerosol formers, flavors, and binders. Tobacco particles may be of the form of a tobacco dust having particles on the order of 30-80 microns or 100-250 microns depending on the desired sheet thickness and casting gap. Fiber particles may include tobacco stem materials, stalks or other tobacco plant material, and other cellulose-based fibers such as wood fibers having a low lignin content. Fiber particles may be selected based on the desire to produce a sufficient tensile strength for the cast leaf versus a low inclusion rate, for example, a rate between approximately 2-15%. Alternatively fibers, such as vegetable fibers, may be used either with the above fibers or in the alternative, including hemp and bamboo.

Aerosol formers included in the slurry that forms cast leaf may be chosen based on one or more characteristics. Functionally, the aerosol former provides a mechanism that allows it to be volatilize and convey nicotine and/or flavouring in an aerosol when heated above the specific volatilization temperature of the aerosol former. An aerosol-former may be any suitable compound or mixture of compounds that, in use, facilitates formation of a dense and stable aerosol and is substantially resistant to thermal degradation at the operating temperature of the heated aerosol-generating article. Different aerosol formers vaporize at different temperatures so an aerosol former may be chosen based on its ability, e.g., to remain stable at or around room temperature but able to volatize at a higher temperature, e.g., between 40-450° C.

The aerosol former may also have humectant type properties that help maintain a desirable level of moisture in an aerosol forming substrate when the substrate is composed of a tobacco-based product including tobacco particle. In particular, some aerosol formers are hygroscopic material that function as a humectant, i.e., a material that helps keep a substrate containing the humectant moist.

One or more aerosol former may be combined to take advantage of one or more properties of the combined aerosol formers. For example, Triactin may be combined with Glycerin and water to take advantage of the Triactin's ability to convey active components and the humectant properties of the Glycerin.

Aerosol formers may be selected from the polyols, glycol ethers, polyol ester, esters, and fatty acids and may comprise one or more of the following compounds: Glycerin, erythritol, 1,3-butylene glycol, tetraethylene glycol, triethylene glycol, Triethyl citrate, Propylene carbonate, Ethyl laurate, Triactin, meso-Erythritol, a Diacetin mixture, a Diethyl suberate, triethyl citrate, benzyl benzoate, benzyl phenyl acetate, ethyl vanillate, tributyrin, lauryl acetate, lauric acid, myristic acid, and Propylene Glycol.

The first continuous reinforcement and the second continuous reinforcement may be continuous elements selected from the list consisting of string, thread, ribbon, tape, cable, cord, and wire. Preferably the continuous reinforcements are fabric tapes.

Preferably, neither the first continuous reinforcement nor the second continuous reinforcement has a width greater than 10% of the width of the continuous web of reconstituted tobacco. Preferably, neither the first continuous reinforcement, nor the second continuous reinforcement has a width greater than 5% of the width of the continuous web of reconstituted tobacco. The first and second continuous reinforcements may need to be removed from the reconstituted tobacco material prior to processing of the reconstituted tobacco material into an aerosol-forming substrate or aerosol-forming article. In such cases it may be convenient to remove the first and second continuous reinforcements by trimming the portions of the reinforced web comprising the reinforcements. That is, it may be convenient to remove the first continuous reinforcement and the second continuous reinforcement from the continuous web of reinforced tobacco by trimming the edges of the continuous web. In such cases, it is preferable that the width of the continuous reinforcements is a low proportion of the width of the reinforced tobacco web to avoid wastage of reconstituted tobacco material.

Preferably the reconstituted tobacco is a reconstituted tobacco for use in forming a heated aerosol-forming substrate. The reconstituted tobacco preferably has an aerosol-former content greater than 5% on a dry weight basis, preferably greater than 10% or 15% on a dry weight basis. The aerosol-former content may comprises one or more aerosol-formers selected from the list consisting of polyhydric alcohols, such as propylene glycol, triethylene glycol, 1,3-butanediol, and glycerine, esters of polyhydric alcohols, such a glycerol, mono, di-, or tri-acetate; and aliphatic esters or mono, di-, or poly carboxylic acids, such a dimethyl, dodecanedioate and dimethyl tetradecanedioate.

Preferable the reinforced tobacco web has a tensile strength that is more than 50% greater than an unreinforced web of the reconstituted tobacco having the same width and thickness. Particularly preferably the tensile strength of the reinforced tobacco web is more than 100% greater, or more than 200% greater than an unreinforced web of the reconstituted tobacco material having the same width and thickness.

A roll of reinforced tobacco web may be provided comprising a continuous web as described above, wound onto a core or into a roll. For example a roll of reinforced tobacco web may comprise a reel or bobbin of reconstituted tobacco having a first continuous reinforcement incorporated into the continuous web at a first edge and a second continuous reinforcement incorporated into the continuous web at a second edge.

Reconstituted tobacco material for use as an aerosol-forming substrate in a heated aerosol-generating article may have a sticky or tacky surface due to the high proportion of aerosol-formers and humectants in the reconstituted tobacco composition. Such stickiness may make it difficult to form rolls of the material for storage or transportation, as stickiness between successive layers of material wound onto the roll may mean the reconstituted tobacco web is difficult to unroll or unwind without breaking the material. By including the first continuous reinforcement and the second continuous reinforcement in the continuous web of reconstituted tobacco when the web is rolled onto a reel or bobbin for storage or transportation the continuous reinforcements may be used to increase the forces that may be applied to unwind the roll of tobacco for subsequent processing, for example processing to form an aerosol-forming substrate. As a consequence, it may become possible to unwind a roll of reinforced tobacco web at a greater speed without breakage thereby avoiding stoppages during manufacturing, reducing scrap rate, and increasing rates of production.

A method forming a reinforced tobacco web may be provided, the reinforced tobacco web having a width defined by a distance between first and second substantially parallel edges. The method comprises the steps of forming a slurry comprising tobacco particles, a binder, and an aerosol-former, positioning a first continuous reinforcement and a second continuous reinforcement on the surface of a continuous belt, the first and second continuous reinforcements being substantially parallel and spatially separated, casting the slurry onto the continuous belt, and drying the slurry to form the continuous web, the first and second continuous reinforcements being incorporated into the reinforced tobacco web at the first and second substantially parallel edges. The reinforced tobacco web may be a web as described above.

The first continuous reinforcement and the second continuous reinforcement may be permanently incorporated into the reinforced tobacco web such that they cannot be removed without also removing the portion of the reconstituted tobacco at the first edge and the second edge of the web. Alternatively, the first continuous reinforcement and the second continuous reinforcement may be incorporated into the reinforced tobacco web in such a manner that they can be peeled from the reconstituted tobacco at a later stage in processing, leaving a web of reconstituted tobacco. Specific embodiments of the invention will now be described with reference to the figures, in which;

Figure 1:
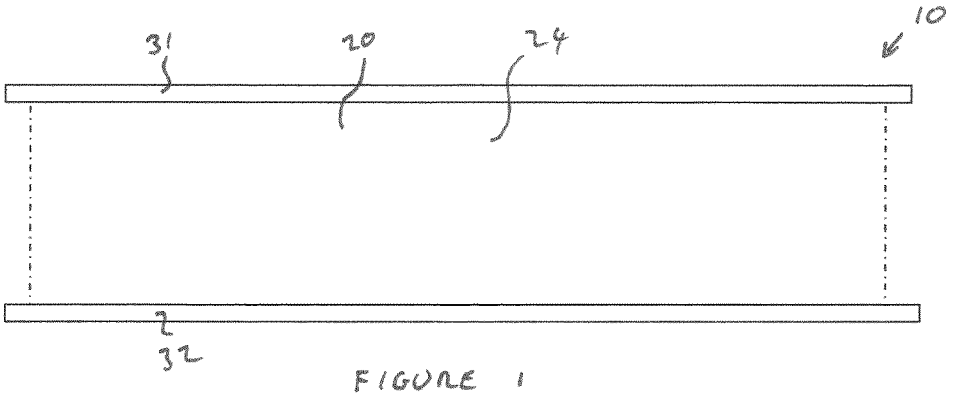
FIG. 1 illustrates an underneath plan view of a section of a reinforced tobacco web showing first and second continuous reinforcements.
Figure 2:
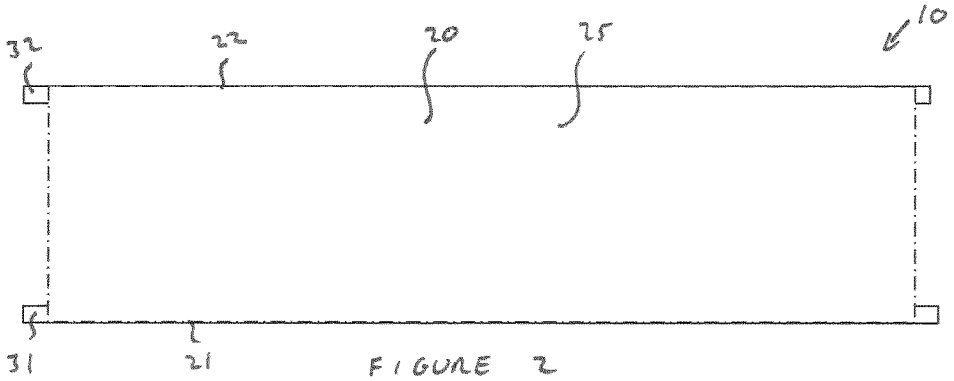
FIG. 2 is a top plan view of the section of the reinforced tobacco web of FIG. 1.

As illustrated in FIGS. 1 and 2 a reinforced tobacco web 10 comprises a sheet or web of reconstituted tobacco 20 having a first edge 21 and a second edge 22. The first edge 21 and the second edge 22 are substantially parallel. The sheet of reconstituted tobacco is a continuous sheet of reconstituted tobacco that has a width of 300 mm and a thickness of 150 micrometers. The sheet 20 is effectively endless in its length dimension.

The sheet of reconstituted tobacco 20 has a lower surface 24 and an upper surface 25. A first continuous reinforcement 31 and second continuous reinforcement 32 are incorporated into the lower surface 24 of the sheet of reconstituted tobacco 20 thereby forming part of the reinforced tobacco web 10. The first continuous reinforcement 31 is located at the first edge of the sheet of reconstituted tobacco 20 and the second continuous reinforcement 32 is located at the second edge 22 of the sheet of reconstituted tobacco. Thus, the reinforced tobacco web comprises reconstituted tobacco 20 and first 31 and second 32 continuous reinforcements.

In a preferred specific embodiment the reinforced tobacco web comprises a cast leaf tobacco material suitable for use as an aerosol-forming substrate in a heated aerosol-generating article. Thus, the cast leaf tobacco material is formed with low fibre content, high aerosol-former content, and relatively high moisture content. Without reinforcement the cast leaf tobacco has a low pulling strength and must be handled carefully to avoid breakage during processing. The incorporation of first and second continuous reinforcements at the lateral edges of the cast leaf tobacco material allows the reinforced tobacco web to be pulled, wound, unwound and conveyed at higher speeds without breakage. Pulling, winding and conveying forces are applied to the lateral edges of the reinforced tobacco web and are transmitted through the first and second reinforcements. These first and second reinforcements effectively support the cast leaf tobacco material and prevent undue stresses and strains being placed on the cast leaf tobacco material.

The first and second continuous reinforcements comprise fabric tapes having a width of 10 mm each. The fibres of the tape engage with the cast leaf tobacco material to ensure intimate contact between the cast leaf tobacco material and the reinforcement tape.

Figure 3:
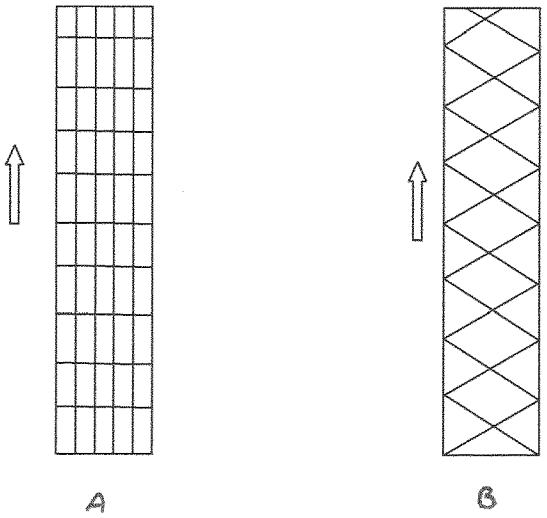
FIG. 3A and FIG. 3B are schematic illustrations showing structures of fabric tapes for use as continuous reinforcements in the reinforced tobacco web of FIG. 1.

The reinforcement material may be a continuous element such as string, thread, ribbon, cable, cord or wire. Preferably, the continuous reinforcement is a fabric tape material. Suitable fabric tapes are available readily and may have a number of different fibre alignments. In preferred embodiments fabric tapes having fibres aligned predominantly in the longitudinal direction of the tape are used. Such a pattern of fabric fibres is illustrated in FIG. 3A. A substantially longitudinal orientation of reinforcement fibres provides maximum strength of the tape in the longitudinal direction. Fabric tapes may be provided having other configurations of fibres, for example as illustrated in FIG. 3B. FIG. 3B shows a fabric tape in which the predominant reinforcement fibre direction is at 45 degrees to the longitudinal direction. While such reinforcements may be of benefit, such a configuration of fabric tape fibres is less preferred as the fabric may be able to extend in its longitudinal direction.

A number of reconstitution processes for producing sheets of reconstituted tobacco materials are known in the art. These include, but are not limited to: paper-making processes of the type described in, for example, U.S. Pat. No. 3,860,012; casting or 'cast leaf' processes of the type described in, for example, U.S. Pat. No. 5,724,998; dough reconstitution processes of the type described in, for example, U.S. Pat. No. 3,894,544; and extrusion processes of the type described in, for example, in GB-A-983,928. Typically, the densities of sheets of homogenised tobacco material produced by extrusion processes and dough reconstitution processes are greater than the densities of sheets of homogenised tobacco materials produced by casting processes.

Reconstituted tobacco material for use in forming reinforced tobacco webs are preferably formed by a casting process of the type generally comprising casting a slurry comprising particulate tobacco and one or more binders onto a conveyor belt or other support surface, drying the cast slurry to form a sheet of homogenised tobacco material and removing the sheet of homogenised tobacco material from the support surface.

Figure 4:
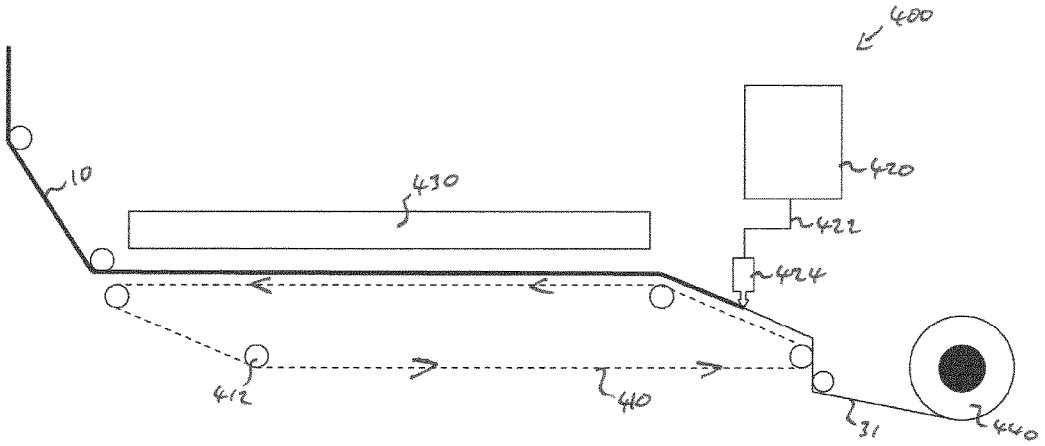
FIG. 4 is a schematic illustration of a portion of an apparatus for forming a reinforced tobacco web as illustrated in FIG. 1.

FIG. 4 illustrates an apparatus for forming a reinforced tobacco web as illustrated in FIG. 1. The apparatus 400 of FIG. 4 comprises a continuous stainless steel belt 410 driven by rollers 412. A hopper 420 containing a liquid tobacco slurry is coupled to a feed line 422 and feed head 424 for applying the liquid tobacco slurry onto a surface of the stainless steel belt 410. The stainless steel belt 410 conveys the slurry cast onto its surface past drying heaters 430 to drive off water from the slurry and form a solidified cast leaf. This process, and similar variations on this process, are well known. In order to apply the first and second continuous reinforcements, a first bobbin of reinforcement material 440 and a second bobbin of reinforcement material (not shown) are arranged to position a first continuous reinforcement 31 and a second continuous reinforcement (not shown in FIG. 4) onto the continuous stainless steel belt 410. The first and second reinforcements are positioned on the continuous belt 410 in a spatially separated arrangement, upstream of the point at which the slurry feeder 424 deposits liquid slurry onto the belt 410. Thus, when the liquid slurry is applied to the belt 410 the first and second continuous reinforcement materials are already positioned on the belt and are incorporated into the continuous web of reconstituted tobacco, thereby forming a reinforced tobacco web. After passing through the drying section of the apparatus the continuous web 10 is conveyed away from the stainless steel belt 410 to undergo further processing, or to be sectioned into lengths, or to be wound into rolls for storage or transportation.

One method of processing a continuous web of reconstituted tobacco to form an aerosol-forming substrate for a heated aerosol-generating article is to gather the web together and circumscribe it a wrapper to form a rod. Such a rod may then be cut into lengths to form individual plugs of aerosol-forming substrate. It is preferred that the first and second continuous reinforcement materials are removed from the reinforced tobacco web prior to the web being gathered to form an aerosol-forming substrate. In order to facilitate handling, however, it is preferred that the reinforcement material is removed immediately prior to the web of material being gathered to form the rod. This enables the material to be handled, for example conveyed, wound and unwound whilst fully utilising the reinforcement material to minimise breakages of the web and maximise processing speed.

Figure 5:
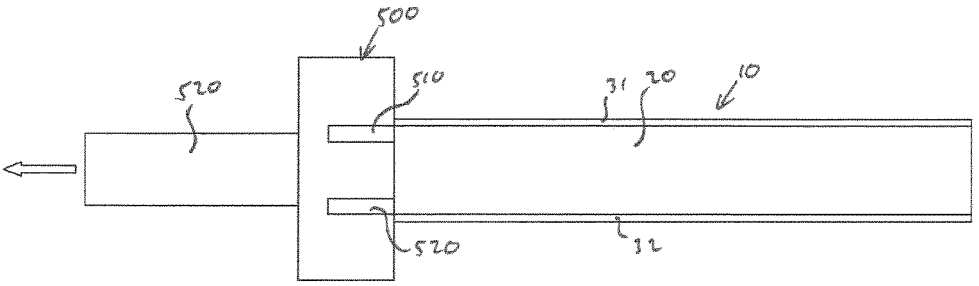
FIG. 5 is a schematic plan view of a portion of apparatus for slicing the first and second reinforcements from a reinforced tobacco web as illustrated in FIG. 1.

In one method of removing the first and second continuous reinforcements, the edges of the reinforced tobacco web may be cut away. An apparatus for performing this process is schematically illustrated in FIG. 5. FIG. 5 shows in plan view a reinforced tobacco web 10 having a first continuous reinforcement 31 and a second reinforcement 32 combined with a continuous sheet of cast leaf tobacco 20. The continuous web is fed towards a slicing apparatus 500. The slicing apparatus 500 comprises a first slicing wheel 510 and a second slicing wheel 520 arranged to slice the edges from the reinforced tobacco web 10 as it passes through the slicing apparatus 500. The edges of the web, including the first and second reinforcements, are removed leaving a continuous web of cast leaf tobacco 520 that may be immediately processed, for example by gathering and forming into a rod. As the continuous web of cast leaf tobacco 520 can be immediately processed after removal of the reinforcement elements, there is very little handling required of the unreinforced web, and the chances of damaging the web are lowered considerably compared with a situation in which the web was never reinforced.

Figure 6:
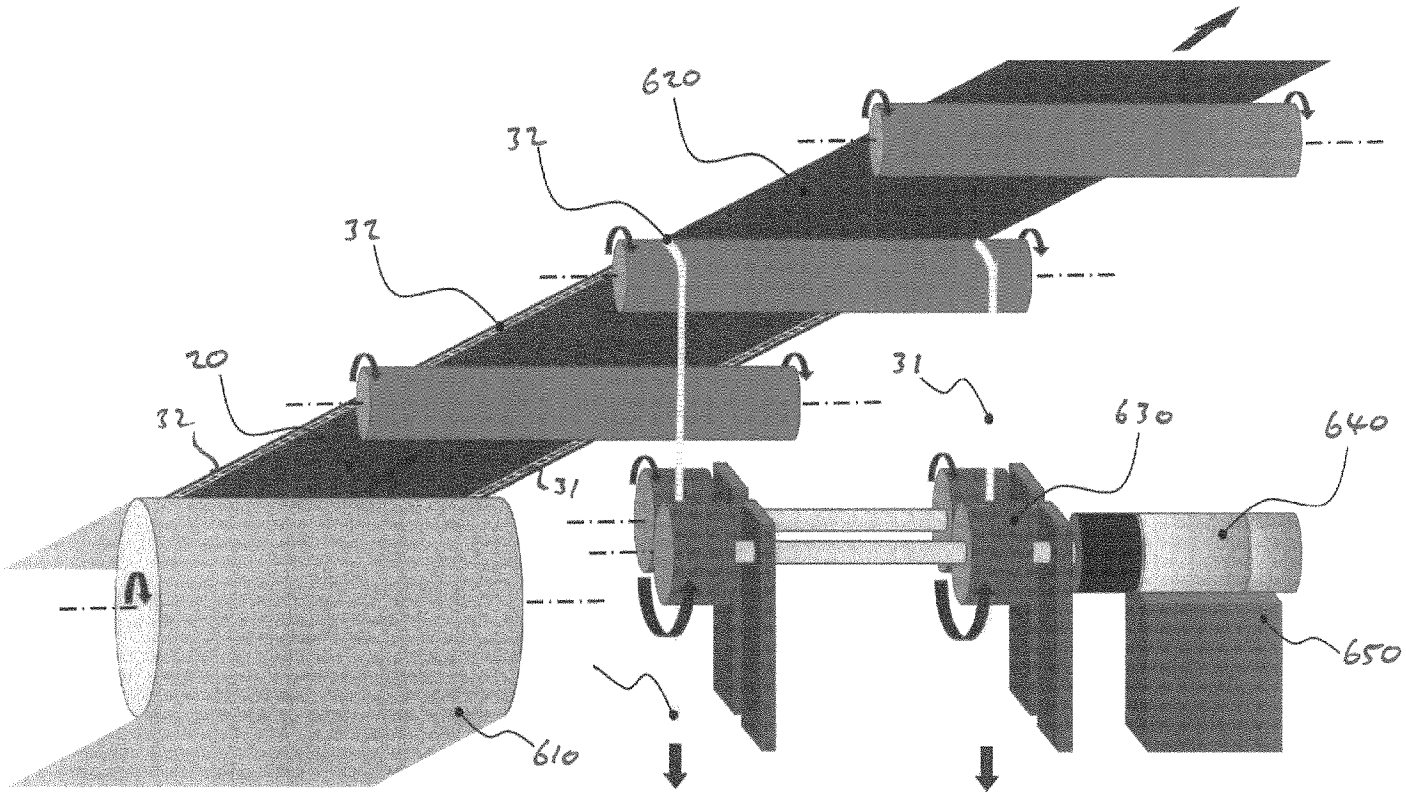
FIG. 6 illustrates a portion of an apparatus for tearing first and second continuous reinforcements from a reinforced tobacco web as illustrated in FIG. 1.

FIG. 6 illustrates an alternative apparatus for removal of the first and second continuous reinforcements 31, 32. The reinforced tobacco web comprising the first reinforcement 31, second reinforcement 32, and sheet of cast leaf 20 may be conveyed by a conveyor belt 610 towards a processing means for gathering the cast leaf into a rod. A set of pulling rollers 630 driven by an electric motor 640 strip the first reinforcement 31 and second reinforcement 32 from the reinforced tobacco web, leaving a continuous web of cast leaf tobacco 620 for subsequent processing. The apparatus includes a speed control unit 650 for synchronising the speed of the pulling rolls with the conveyor belt 610. This method may be advantageous as less cast leaf tobacco material is wasted when the reconstituted tobacco is removed from the reinforced tobacco web.

The invention claimed is:

1. A reinforced tobacco web, comprising:

a continuous web of reconstituted tobacco having a width defined by a distance between first and second substantially parallel edges, wherein a first continuous reinforcement is incorporated into the continuous web of reconstituted tobacco at the first edge and a second continuous reinforcement is incorporated into the continuous web of reconstituted tobacco at the second edge to form the reinforced tobacco web, and wherein neither the first continuous reinforcement nor the second continuous reinforcement has a width greater than 15% of the width of the continuous web of reconstituted tobacco.

2. The reinforced tobacco web according to claim 1, wherein the first continuous reinforcement and the second continuous reinforcement are continuous elements selected from a list consisting of string, thread, ribbon, tape, cable, cord, and wire.

3. The reinforced tobacco web according to claim 1, wherein neither the first continuous reinforcement nor the second continuous reinforcement has a width greater than 10% of the width of the continuous web of reconstituted tobacco.

4. The reinforced tobacco web according to claim 1, wherein neither the first continuous reinforcement nor the second continuous reinforcement has a width greater than 5% of the width of the continuous web of reconstituted tobacco.

5. The reinforced tobacco web according to claim 1, wherein the continuous web of reconstituted tobacco is configured to form a heated aerosol-forming substrate and has an aerosol-former content of greater than 5% on a dry weight basis.

6. The reinforced tobacco web according to claim 1, wherein the reinforced tobacco web has an aerosol-former content of greater than 10% on a dry weight basis.

7. The reinforced tobacco web according to claim 5, wherein the aerosol-former content consists of at least one aerosol-former selected from a list consisting of polyhydric alcohols including at least one of propylene glycol, tri ethylene glycol, 1,3-butanediol, and glycerine; esters of polyhydric alcohols including at least one of glycerol, monoacetate, diacetate, and triacetate; and aliphatic esters of monocarboxylic acid, dicarboxylic acid, or polycarboxylic acid, including at least one of dimethyl dodecanedioate and dimethyl tetradecanedioate.

8. The reinforced tobacco web according to claim 1, wherein the reinforced tobacco web has a tensile strength that is more than 50% greater than that of an unreinforced web of the reconstituted tobacco having a same width and a same thickness as that of the reinforced tobacco web.

9. The reinforced tobacco web according to claim 1, wherein the reinforced tobacco web has a tensile strength that is more than 100% greater than that of an unreinforced web of the reconstituted tobacco having a same width and a same thickness as that of the reinforced tobacco web.

10. A roll of reconstituted tobacco, comprising:

a reinforced tobacco web wound onto a core, said web comprising a continuous web of reconstituted tobacco having a width defined by a distance between first and second substantially parallel edges, wherein a first continuous reinforcement is incorporated into the continuous web of reconstituted tobacco at the first edge and a second continuous reinforcement is incorporated into the continuous web of reconstituted tobacco at the second edge to form the reinforced tobacco web, and wherein neither the first continuous reinforcement nor the second continuous reinforcement has a width greater than 15% of the width of the continuous web of reconstituted tobacco.

11. The roll of reconstituted tobacco according to claim 10, wherein the core is a reel or a bobbin.

12. A method of forming a reinforced tobacco web having a width defined by a distance between first and second substantially parallel edges, comprising:

forming a slurry comprising tobacco particles, a binder, and aerosol-former;

positioning a first continuous reinforcement and a second continuous reinforcement on a surface of a continuous belt, the first and the second continuous reinforcements being substantially parallel and spatially separated;

casting the slurry onto the continuous belt; and drying the slurry to form the reinforced tobacco web, the first and second continuous reinforcements being incorporated into the reinforced tobacco web at the first and the second substantially parallel edges.

13. The method according to claim 12, wherein the reinforced tobacco web comprises a continuous web of reconstituted tobacco having a width defined by a distance between the first and the second substantially parallel edges, wherein the first continuous reinforcement is incorporated into the continuous web of reconstituted tobacco at the first edge and the second continuous reinforcement is incorporated into the continuous web of reconstituted tobacco at the second edge, and wherein neither the first continuous reinforcement nor the second continuous reinforcement has a width greater than 15% of the width of the continuous web of reconstituted tobacco.

* * * * *